United States Patent [19]

Djukastein

[11] Patent Number: 4,949,216

[45] Date of Patent: Aug. 14, 1990

[54] APPARATUS FOR DISCOURAGING ANIMALS FROM A SELECTED AREA

[75] Inventor: Klaus Djukastein, Sidney, Canada

[73] Assignee: Contech Electronics Inc., Sidney, Canada

[21] Appl. No.: 208,451

[22] Filed: Jun. 17, 1988

[51] Int. Cl.[5] ..... H05F 3/02

[52] U.S. Cl. ..... 361/232; 119/29

[58] Field of Search ..... 361/232; 43/59, 98, 43/124; 119/29; 340/573

[56] References Cited

U.S. PATENT DOCUMENTS

| | | | |
|---|---|---|---|
| 3,197,916 | 8/1965 | Cole, Jr. et al. | 43/98 |
| 4,118,752 | 10/1978 | Iguchi | 361/232 |
| 4,274,123 | 6/1981 | Rogers, Jr. | 361/232 |

*Primary Examiner*—Brian W. Brown

*Attorney, Agent, or Firm*—Berman, Aisenberg & Platt

[57] ABSTRACT

A device for discouraging small domestic or wild animals from frequenting areas where they may become a nuisance. The device comprises a mat made of non-conductive material to be spread over the area. A plurality of conductive surfaces are spaced on the upper surface of the mat so that adjacent conductive surfaces are electrically insulated from each other. An electric control is associated with the conductive surfaces and provides electric power thereto so that when an animal walks on the mat its body completes a circuit between live and ground areas on the mat and the animal is thereby provided with an unpleasant electrical sensation.

5 Claims, 1 Drawing Sheet

APPARATUS FOR DISCOURAGING ANIMALS FROM A SELECTED AREA

BACKGROUND OF THE INVENTION

The present invention relates to a device for discouraging small domestic or wild animals from frequenting areas where they may become a nuisance.

More particularly, the present invention is directed towards the problem, both in the city and in the country, of animals being a nuisance, e.g. in overturning garbage cans, or walking on automobiles leaving footprints and scratches over the automobile surface.

When garbage cans and automobiles are stored or parked in areas frequented by wild or domestic animals it is very difficult to keep animals out of garbage cans or off of automobiles. Chemical repellents are available to discourage animals from garbage cans and the like. Some of these chemical deterrents are intended as dog or cat repellents and are provided in an aerosol can or spray bottle.

Prior art devices are also known for killing rodents and insects, and electric fences for stunning or training animals to stay within certain bounds.

It is an object of the present invention to provide a device which will be effective to keep animals off of the hoods of cars, out of garbage cans, off of furniture and the like.

It is a further object of the present invention to provide such a device which will not injure the animal, but which will discourage the animal from trespassing in a certain area.

SUMMARY OF THE INVENTION

In accordance with the present invention there is provided a device for discouraging small domestic or wild animals from frequenting areas where they may become a nuisance. This device comprises a mat made of non-conductive material to be spread over said area, a plurality of conductive surfaces spaced on the upper surface of the mat so that adjacent conductive surfaces are electrically insulated from each other, and electric control means associated with the conductive areas to provide electric power thereto. The control means and conductive surfaces are arranged so that, when an animal comes into contact with the mat, a portion of its body completes a circuit between adjacent live and ground conductive surfaces on the mat and the animal is thereby provided with an unpleasant electrical sensation.

In a preferred embodiment of the device according to the present invention, the conductive surfaces are in the form of strips of conductive material electrically associated with the control means to provide alternating ground and live strips over the upper surface area of the mat, when the electric control means is operational. The control means produces, when operational, very short duration electrical pulses to the live strips.

The mat in accordance with the present invention is intended to be placed over a garbage can, on the hood of a car, on furniture, over a bird cage, on kitchen counters, etc. It does not damage the article or area over which it is placed while at the same time it is effective in providing a trespassing animal with an unpleasant sensation when its body completes an electrical circuit between the live and ground surfaces on the mat. Such animal will then associate this location with an unpleasant sensation and stay away from it in future. This is achieved without injuring the animal.

BRIEF DESCRIPTION OF THE DRAWINGS

These and other objects and advantages of the invention will become apparent upon reading the following detailed description and upon referring to the drawings in which.

Figure 1:
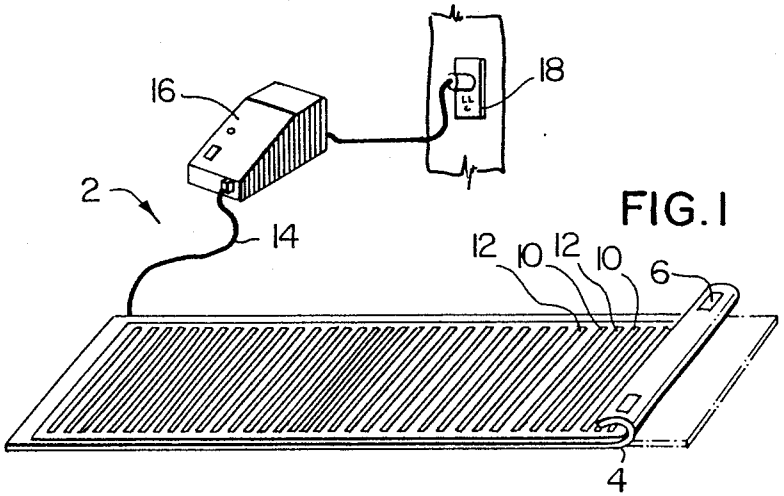
FIG. 1 is a schematic view, in perspective, of a mat in accordance with the present invention.

While the invention will be described in conjunction with an example embodiment, it will be understood that it is not intended to limit the invention to such embodiment. On the contrary, it is intended to cover all alternatives, modifications and equivalents as may be included within the spirit and scope of the invention as defined by the appended claims.

DETAILED DESCRIPTION OF THE INVENTION

In the following description, similar features in the drawings have been given similar reference numerals.

Turning to FIG. 1, there is illustrated a device 2 in accordance with the present invention, comprising a mat 4, preferably made of a flexible, non-conductive plastic material so that the mat may for example be securely anchored on the hood of a car, over a garbage can, etc. The mat 4 may have any appropriate dimensions, and may be of rectangular or any other desired shape. Anchoring means in the form of, for example, magnetic strips 6 may be secured along the edges of the lower surface of mat 4.

On the upper surface of mat 4 are a plurality of conductive strips 10 and 12 spaced across that upper surface in parallel fashion as illustrated. These strips are arranged with appropriate electric circuitry so that electric power is provided to alternate strips 10 across the surface of the mat (live strips) while the strips 12 therebetween are neutral or grounded. It is preferred that these strips be placed about one inch apart for most effective results against animals such as cats, raccoons and the like, as the animal's feet on the mat surface will then cause completion of the circuit. While the strips are illustrated as being laid out in parallel fashion over the surface of mat 4, it will be understood that any layout of conductive areas, so that over a predetermined area of the mat, in a one or one and a half square inch area of the mat there will be adjacent ground and live conductive surfaces so that a part of an animal's body on that area will complete the circuit, will be effective for the purposes of this invention. The strips forming this circuitry are connected by electrical lead 14 to an electrical control 16 which plugs into a standard wall outlet 18 as illustrated, to provide, when the power is switched on, very short duration electrical pulses at intervals of for example about one per second. As the conductive strips 8 are spaced so that they are electrically insulated from each other, a trespassing animal walking on the surface of the mat will complete an electrical circuit between one or more pairs of adjacent live strips 10 and ground strips 12, with either a single paw of that animal or with several parts of its body. The power provided to strips 10 and 12 is not intended to injure such an animal, but merely to provide it with an unpleasant electrical sensation in the form of a small electrical shock, thereby discouraging the animal from trespassing again in the area covered by the mat.

Figure 2:
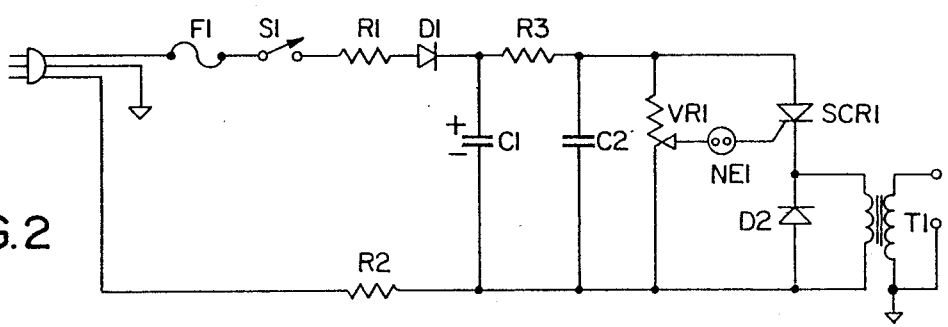
FIG. 2 is a circuit diagram of the electrical circuitry of the mat device of FIG. 1.

FIG. 2 illustrates appropriate example circuitry for the mat 4 and control unit 16 of FIG. 1.

The mat device according to the present invention can be used in place of conventional animal repellent chemicals and will not damage a fabric or metallic surface, such as a car hood, over which it is placed. It uses very little power and, once in place and activated, can effectively discourage the trespassing of pets or wild animals over that area for extended periods of time.

Thus it is apparent that there has been provided in accordance with the invention, mat device for discouraging small domestic or wild animals from frequenting areas where they may become a nuisance, that fully satisfies the objects, aims and advantages set forth above. While the invention has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A device for discouraging small domestic or wild animals from frequenting areas where they may become a nuisance, comprising:

(a) a mat made of non-conductive material to be spread over said area;

(b) a continuous and substantially flat upper surface;

(c) a plurality of conductive strips closely spaced in comparison to the length of said surface and spaced on said upper surface of the mat so that adjacent conductive surfaces are electrically insulated from each other and are, alternatingly, live and grounded; and (d) electric control means associated with the conductive surfaces to provide a series of electrical pulses to the conductive surfaces, said pulses being spaced by about one second and having durations of substantially less than one second;

the electric control means and conductive surfaces being arranged so that, when an animal comes into contact with the mat, a portion of its body completes a circuit between adjacent live and ground conductive surfaces on the mat and the animal is thereby provided with an unpleasant electrical sensation.

2. A device according to claim 1 wherein the material is flexible plastic.

3. A device according to claim 1 wherein the mat is of flexible construction.

4. A device according to claim 3 wherein the mat is further provided with means to permit anchoring of the device on said area.

5. A device according to claim 4 wherein the anchoring means is a plurality of magnetic strips spaced on the edges of the lower surface of the mat.

* * * * *